US008690613B2

(12) United States Patent
Yoshida et al.

(10) Patent No.: US 8,690,613 B2
(45) Date of Patent: Apr. 8, 2014

(54) CONNECTOR EASILY ENABLING A REDUCTION IN THICKNESS AND BEING STRUCTURALLY STABLE

(75) Inventors: Takushi Yoshida, Tokyo (JP); Hiroshi Akimoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 134 days.

(21) Appl. No.: 13/406,973

(22) Filed: Feb. 28, 2012

(65) Prior Publication Data

US 2012/0244758 A1 Sep. 27, 2012

(30) Foreign Application Priority Data

Mar. 24, 2011 (JP) ..... 2011-065545

(51) Int. Cl.
*H01R 12/00* (2006.01)

(52) U.S. Cl.
USPC ..... 439/862

(58) Field of Classification Search
USPC ..... 439/66, 91, 862
See application file for complete search history.

(56) References Cited

U.S. PATENT DOCUMENTS

| | | | | |
|---|---|---|---|---|
| 5,173,055 | A * | 12/1992 | Grabbe | 439/66 |
| 6,328,573 | B1 * | 12/2001 | Sakata et al. | 439/66 |
| 6,447,338 | B1 * | 9/2002 | Bricaud et al. | 439/630 |
| 6,908,318 | B2 * | 6/2005 | Kawate | 439/91 |
| 6,926,536 | B2 | 8/2005 | Ochiai | |
| 7,955,135 | B2 * | 6/2011 | Wang et al. | 439/630 |

FOREIGN PATENT DOCUMENTS

JP 2004-221052 8/2004

* cited by examiner

*Primary Examiner* — Neil Abrams
(74) *Attorney, Agent, or Firm* — Collard & Roe, P.C.

(57) ABSTRACT

A conductive terminal member is disposed at a portion between an insulating base film and an insulating cover film while insulating intermediate members are disposed at other portions therebetween. In this event, the intermediate members are formed in predetermined shapes and are located so as not to overlap the terminal member. The base film and the cover film are each melt-fixed to the intermediate members so that the terminal member is fixedly held between the base member and the cover film and with the terminal member 14 bent to penetrate windows 11*b*, 11*c* in the base and cover to form contact portions 14*a*, 14*c*.

10 Claims, 7 Drawing Sheets

CONNECTOR EASILY ENABLING A REDUCTION IN THICKNESS AND BEING STRUCTURALLY STABLE

This application is based upon and claims the benefit of priority from Japanese patent application No. 2011-065545, filed on Mar. 24, 2011, the disclosure of which is incorporated herein in its entirety by reference.

TECHNICAL FIELD

This invention relates to a connector and, in particular, relates to a connector comprising insulating film members and conductive terminal members held by the film members.

BACKGROUND ART

In general, a connector comprises a housing made of insulating plastic and conductive terminal members held by the housing. The housing is normally made by molding using a mold. The terminal members are held by the housing using a method of molding the housing into a predetermined shape in advance and then attaching the terminal members to the housing or a method of embedding the terminal members in the housing by insert injection molding when molding the housing.

However, in the case of the connector described above, since the housing is molded using the mold, the filling property of the material when molding the housing is poor and, further, the processing of the mold is laborious and thus its manufacture requires much time, leading to a high processing cost.

In view of this, in recent years, there has been proposed a connector in which an insulating film member has the function of a housing (see Patent Document 1: JP-A-2004-221052). In Patent Document 1, this type of connector is called a contact sheet. This contact sheet will be described with reference to FIGS. 1A and 1B.

In FIGS. 1A and 1B, a contact sheet 1 is made using upper and lower bonding sheets 2 and 3 and an adhesive sheet 4 interposed therebetween (FIG. 1A) and the upper and lower bonding sheets 2 and 3 are bonded to each other through the adhesive sheet 4 interposed therebetween (FIG. 1B). The upper bonding sheet 2 comprises a base sheet 2*a* formed from a film member and a plurality of contacts 2*b* each formed from a metal sheet. A part of each contact 2*b* is bonded by an adhesive to a lower surface of the base sheet 2*a*. The lower bonding sheet 3 comprises a base sheet 3*a* formed from a film member and a plurality of contacts 3*b* each formed from a metal sheet. A part of each contact 3*b* is bonded by an adhesive to an upper surface of the base sheet 3*a*. The contacts 2*b* are disposed spaced apart from each other and, likewise, the contacts 3*b* are disposed spaced apart from each other.

Since the base sheets 2*a* and 3*a* having the function of a housing are each formed from the film member, the contact sheet 1 shown in FIGS. 1A and 1B contributes to solving the problems of the housing which is molded using the mold.

SUMMARY OF THE INVENTION

However, since the contact sheet 1 shown in FIGS. 1A and 1B has the stacked structure in which the parts of the contacts 2*b*, the adhesive sheet 4, and the parts of the contacts 3*b* are interposed between the two base sheets 2*a* and 3*a*, a further reduction in thickness is difficult to achieve. Further, since the adhesive is interposed between the base sheets 2*a* and 3*a* and the parts of the contacts 2*b* and 3*b* bonded thereto, this also increases the thickness of the contact sheet 1.

Further, since the contacts 2*b* and 3*b* are interposed only at portions between the base sheets 2*a* and 3*a* and the adhesive sheet 4, gaps remain at other portions between the base sheets 2*a* and 3*a* and the adhesive sheet 4. There is a possibility that these gaps cause the posture of the contacts 2*b* and 3*b* to be unstable. Even if the adhesive flows into these gaps and is cured, it is insufficient to stably hold the posture of the contacts 2*b* and 3*b*.

It is therefore an exemplary object of this invention to provide a connector which easily enables a reduction in thickness and which is structurally stable.

It is another exemplary object of this invention to provide a method of manufacturing the above-mentioned connector.

Other object of the present invention will become clear as the description proceeds.

According to an exemplary aspect of the present invention, there is provided a connector comprising a base member having insulating property, a cover member having an insulating property and facing the base member with a space left therebetween, a terminal member having a conducting property and disposed between a portion of the base member and a portion of the cover member, and an intermediate member having an insulating property and disposed between another portion of the base member and another portion of the cover member, wherein the intermediate member is formed in a predetermined shape and is located adjacent to the terminal member, and the base member and the cover member are each melt-fixed to the intermediate member, whereby the terminal member is fixedly held between the base member and the cover member.

According to another exemplary aspect of the present invention, there is provided a connector manufacturing method comprising a base member forming step of processing a first sheet member by a laser beam or pressing, thereby forming a base member having a predetermined shape, an intermediate member forming step of processing a second sheet member by a laser beam or pressing, thereby forming an intermediate member having a predetermined shape, a primary member forming step of melt-fixing the base member and the intermediate member together to integrate them together, thereby forming a primary member, a terminal member forming step of processing a metal sheet by a laser beam or pressing, thereby forming a terminal member having a predetermined shape, a cover member forming step of processing a third sheet member by a laser beam or pressing, thereby forming a cover member having a predetermined shape, a disposing step of disposing the terminal member at a predetermined position of the primary member and then disposing the cover member at a predetermined position over the terminal member, a secondary member forming step of melt-fixing the intermediate member and the cover member together, thereby forming a secondary member in which the terminal member is fixedly held between the base member and the cover member, and a connector forming step of processing the secondary member into a predetermined shape, thereby forming a connector.

EXEMPLARY EMBODIMENTS

Referring to FIGS. 2A to 8B, a connector according to a first embodiment of this invention will be described using its manufacturing method.

First, a first sheet member, a second sheet member, and a third sheet member are prepared. The first, second, and third sheet members may be made of the same insulating plastic material, but may alternatively be made of different materials.

The first, second, and third sheet members are each preferably a resin film obtained by forming thermoplastic plastic (e.g. LCP, Ny, PPS, or PBT resin) into a sheet or film shape. The first sheet member preferably has a thickness of about 25 μm, the second sheet member a thickness of 100 μm to 120 μm, and the third sheet member a thickness of about 25 μm. In particular, the first and third sheet members each preferably have a transmittance of 20% or more for light having a wavelength of 600 nm to 1200 nm. The second sheet member preferably has an absorbance of 50% or more for light having a wavelength of 600 nm to 1200 nm.

Further, a metal sheet member is prepared. The metal sheet member is preferably obtained by forming a material excellent in conductivity into a sheet or film shape. The thickness of the metal sheet member is preferably slightly smaller than that of the second sheet member and thus is preferably, for example, about 80 μm.

Figure 1A:
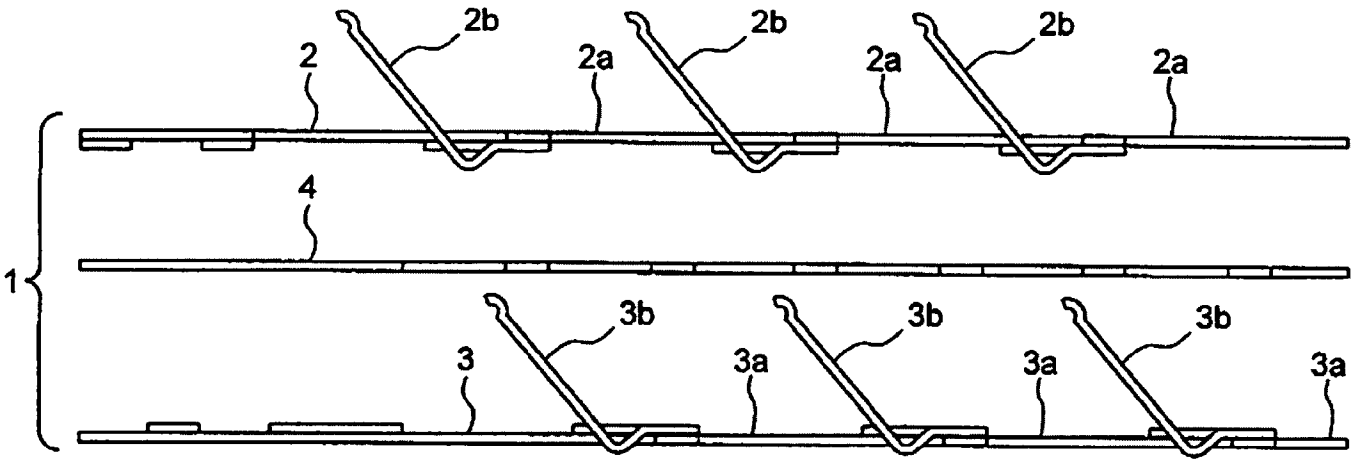
FIG. 1A PRIOR ART
FIG. 1A is a side view showing a state, before bonding, of a prior art contact sheet.
Figure 1B:
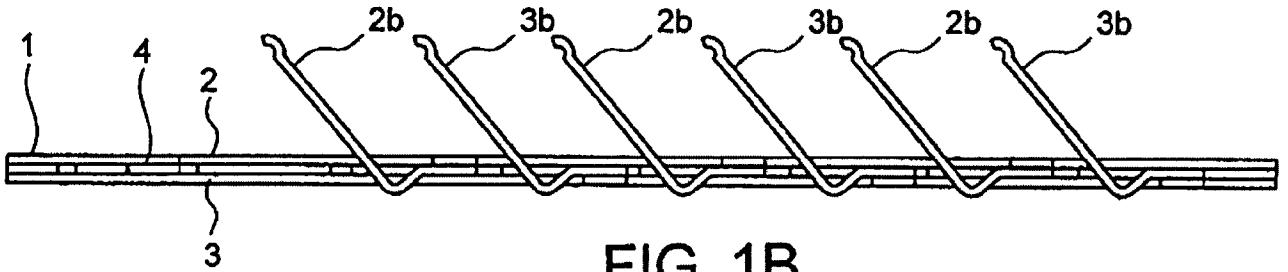
FIG. 1B PRIOR ART
FIG. 1B is a side view showing a state, after bonding, of the prior art contact sheet.
Figure 2A:
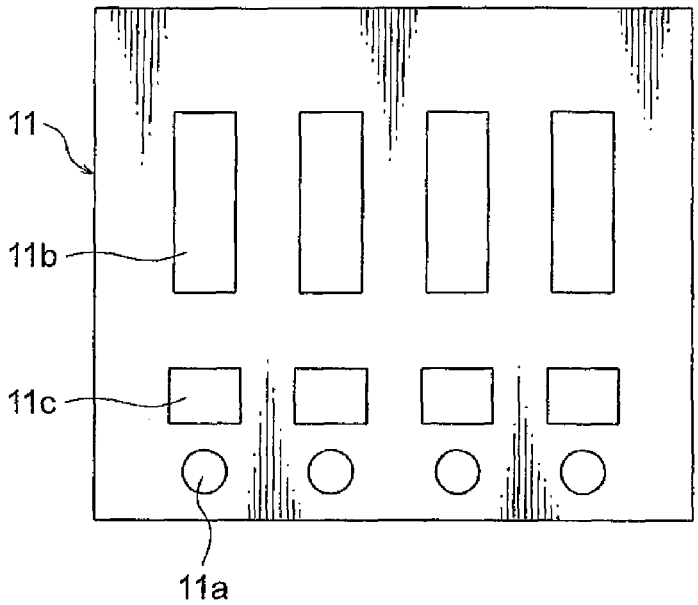
FIG. 2A is a plan view of a base member for use in the manufacture of a connector according to a first embodiment of this invention.
Figure 2B:
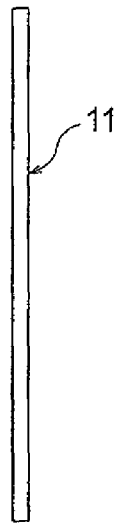
FIG. 2B is a side view of the same.

Then, as shown in FIGS. 2A and 2B, the first sheet member is processed by a laser beam, pressing, or the like, thereby forming a film-like base member 11 having a predetermined shape (base member forming step). Specifically, the roll-like resin film is continuously punched by a laser beam, pressing, or the like, thereby forming the base member 11. The base member 11 has four positioning holes 11*a* arranged in a row, four large windows 11*b* penetrating in its thickness direction, and four small windows 11*c* penetrating in its thickness direction. A pair of the large window 11*b* and the small window 11*c* are formed so as to correspond to the side of each positioning hole 11*a*.

Figure 3A:
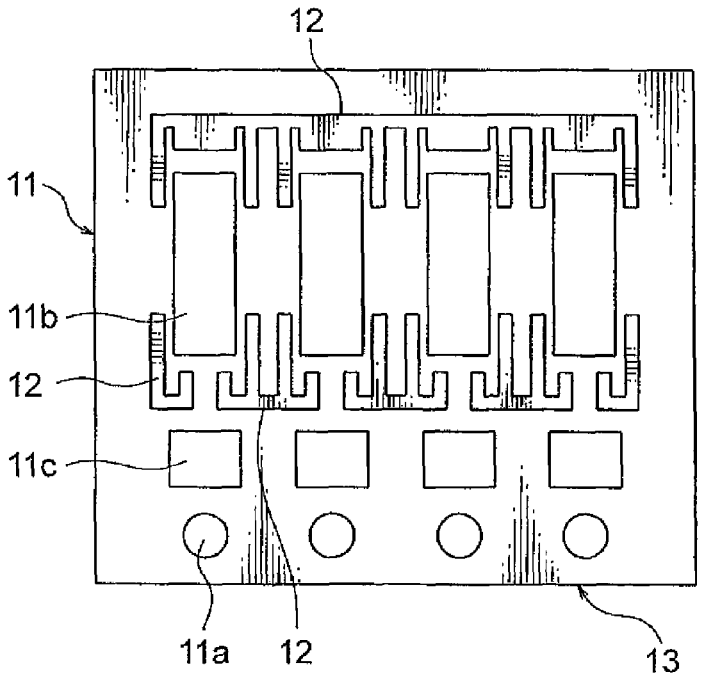
FIG. 3A is a plan view of a primary member formed by fixing intermediate members to the base member.
Figure 3B:
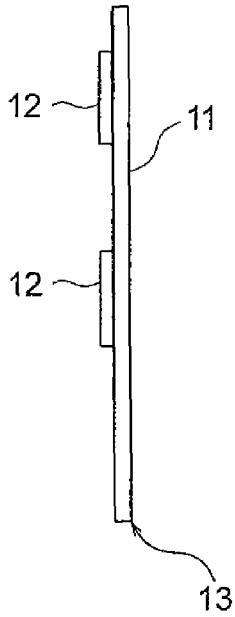
FIG. 3B is a side view of the same.

As shown in FIGS. 3A and 3B, the second sheet member is processed by a laser beam, pressing, or the like, thereby forming a plurality of divided insulating intermediate members 12 having predetermined shapes (intermediate member forming step), and these intermediate members 12 are disposed on a first surface of the base member 11 and then are melt-fixed (fixed by melting or thermally fixed) to the base member 11 by a laser beam (light having a wavelength of 600 nm to 1200 nm) so as to be integrated with the base member 11, thereby forming a primary member 13 (primary member forming step). The intermediate members 12 are located slightly away from the large windows 11*b* of the base member 11. The laser beam is preferably irradiated from the opposite surface side of the base member 11, i.e. irradiated to a second surface, opposite to the first surface where the intermediate members 12 are disposed, of the base member 11. In this event, a part of the laser beam passes through the base member 11 so as to be absorbed by the intermediate members 12. As a consequence, the base member 11 and/or the intermediate members 12 are/is properly melted so that interface portions thereof are melt-fixed to each other so as to be integrated with each other. In this event, although the laser beam is used for melt-fixing in the above description, an ultrasonic wave and/or a heater may be used for the meld fixing.

Figure 4A:
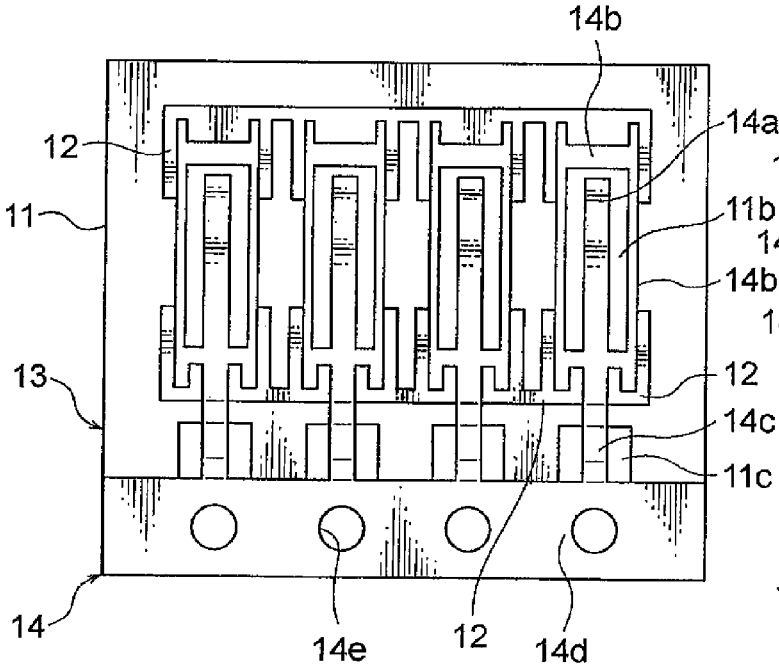
FIG. 4A is a plan view showing a combination of the primary member and a terminal member.
Figure 4B:
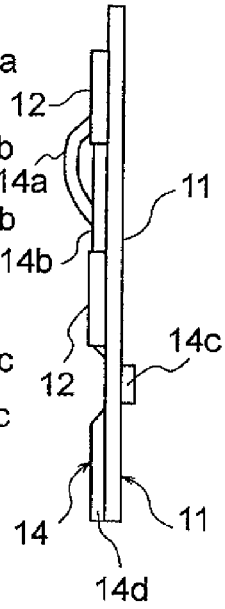
FIG. 4B is a side view of the same.

Further, as shown in FIGS. 4A and 4B, the metal sheet member is processed by a laser beam, pressing, or the like, thereby integrally forming a conductive terminal member 14 having a predetermined shape (conductive terminal member forming step), and this terminal member 14 is disposed at a predetermined position of the primary member 13. Specifically, the terminal member 14 is disposed on the first surface of the base member 11 so as not to overlap the intermediate members 12.

The terminal member 14 has four cantilever contact portions 14*a* disposed so as to respectively correspond to the large windows 11*b* of the base member 11, four frame portions 14*b* respectively adjacent to the large windows 11*b* and respectively surrounding the contact portions 14*a*, four connecting portions 14*c* disposed so as to respectively correspond to the small windows 11*c* of the base member 11, and a joining portion 14*d* joining them together. The joining portion 14*d* is formed with four positioning holes 14*e* which respectively correspond to the positioning holes 11*a* of the base member 11. Each contact portion 14*a* is bent so as to protrude in a direction away from the first surface of the base member 11. Each connecting portion 14*c* is bent so as to pass through the small window 11*c* of the base member 11 to protrude from the opposite surface, i.e. the second surface, of the base member 11.

Figure 5A:
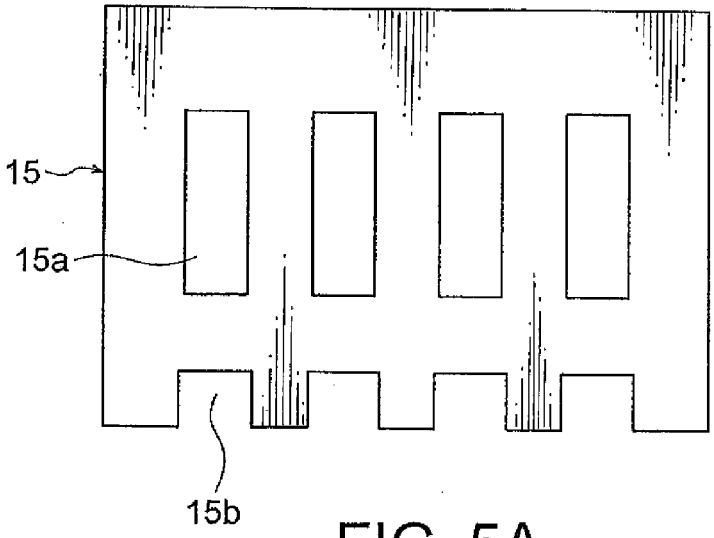
FIG. 5A is a plan view of a cover member for covering the intermediate members and the terminal member in cooperation with the base member of FIGS. 2A and 2B.
Figure 5B:
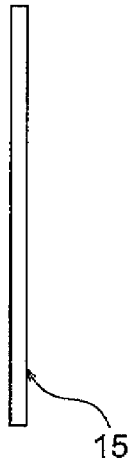
FIG. 5B is a side view of the same.

Further, as shown in FIGS. 5A and 5B, the third sheet member is processed by a laser beam, pressing, or the like, thereby forming a film-like cover member 15 having a predetermined shape (cover member forming step). The cover member 15 has four openings 15*a* having the same shape and size as those of the large windows 11*b* of the base member 11 and formed at positions which respectively correspond to those of the large windows 11*b*, and four cutout portions 15*b* formed at positions which respectively correspond to those of the small windows 11*c* of the base member 11.

Although the cover member 15 shown in FIGS. 5A and 5B has no portion corresponding to the portion, where the positioning holes 11*a* are formed, of the base member 11, the cover member 15 may be a member having the same shape as that of the base member 11 or may be the same member as the base member 11.

Figure 6A:
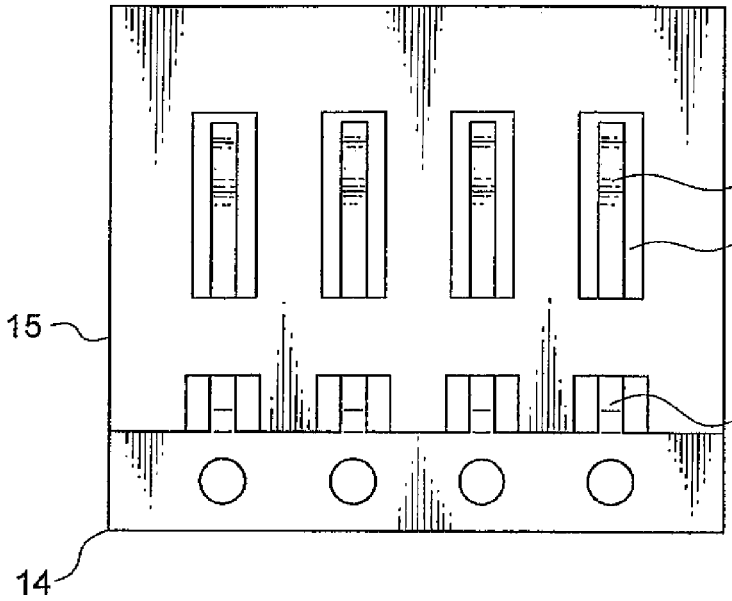
FIG. 6A is a plan view showing a combination of the combination shown in FIGS. 4A and 4B and the cover member of FIGS. 5A and 5B.
Figure 6B:
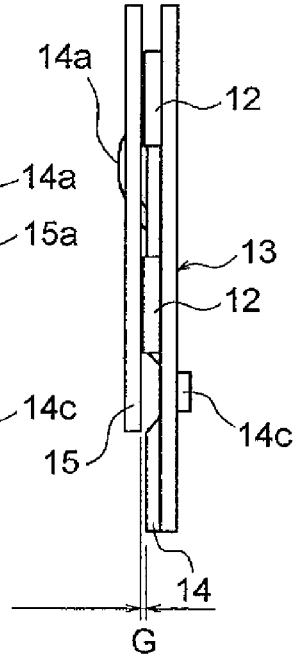
FIG. 6B is a side view of the same.

Then, as shown in FIGS. 6A and 6B, with respect to the primary member 13 with the terminal member 14 disposed thereon, the cover member 15 is disposed at a predetermined position over the terminal member 14 (disposing step). In this event, the contact portions 14*a* of the terminal member 14 pass through the openings 15*a* of the cover member 15 so as to protrude to the outside. In this state, since the intermediate members 12 are formed slightly thicker than the terminal member 14, a small gap G (e.g. 20 μm to 40 μm) remains between the terminal member 14 and the cover member 15.

Figure 7A:
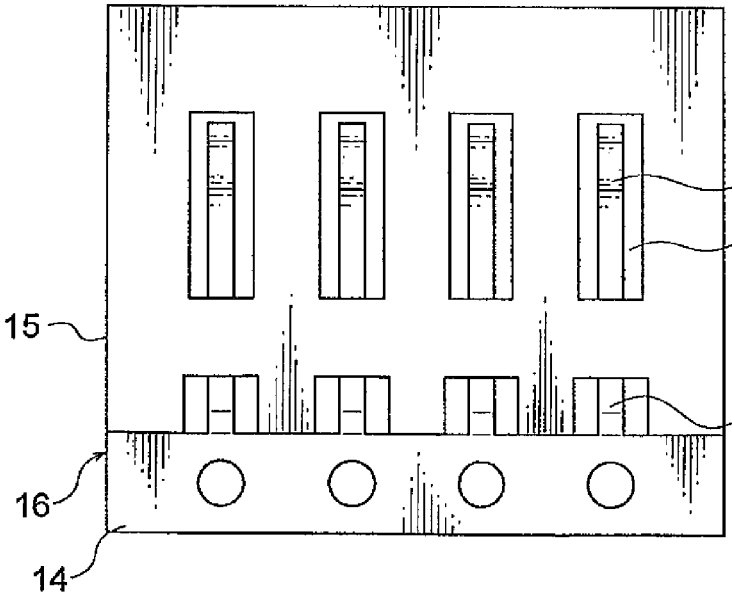
FIG. 7A is a plan view of a secondary member formed by fixing the cover member to the intermediate members in the state of FIGS. 6A and 6B.
Figure 7B:
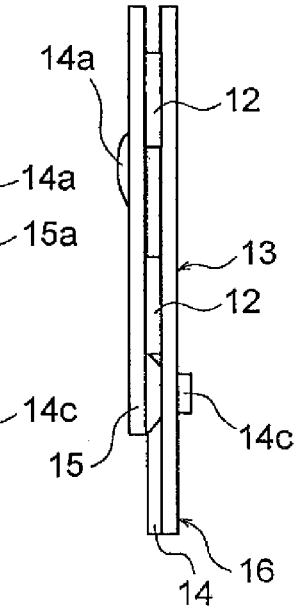
FIG. 7B is a side view of the same.

Thereafter, as shown in FIGS. 7A and 7B, the intermediate members 12 and the cover member 15 are melt-fixed to each other by a laser beam (light having a wavelength of 600 nm to 1200 nm), thereby forming a secondary member 16 in which the terminal member 14 is fixedly held between the base member 11 and the cover member 15 (secondary member forming step). The laser beam is preferably irradiated from the outer surface side of the cover member 15, i.e. irradiated to a surface, exposed to the outside, of the cover member 15. In this event, a part of the laser beam passes through the cover member 15 so as to be absorbed by the intermediate members 12. As a consequence, the intermediate members 12 and/or the cover member 15 are/is properly melted so that interface portions thereof are melt-fixed to each other so as to be integrated with each other. In this event, although the laser beam is used for melt-fixing in the above description, an ultrasonic wave and/or a heater may be used in the melt-fixing. Further, various gaps between the base member 11 and the cover member 15 can be buried with the intermediate members 12.

Figure 8A:
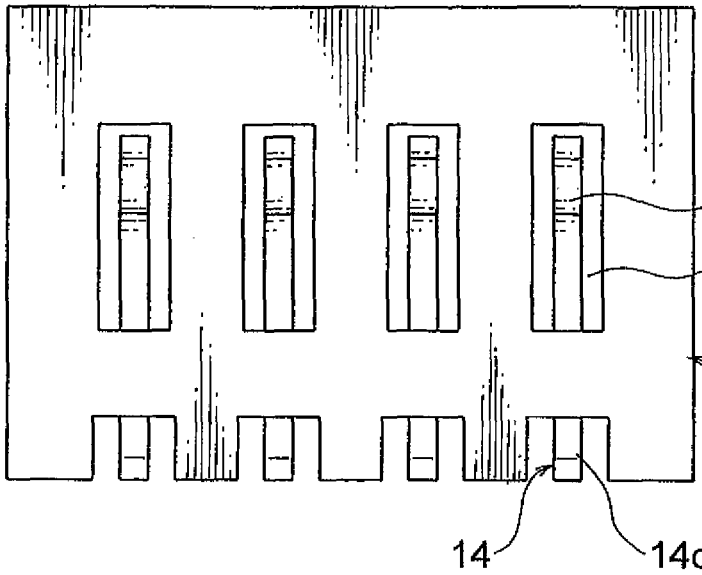
FIG. 8A is a plan view of the connector according to the first embodiment.
Figure 8B:
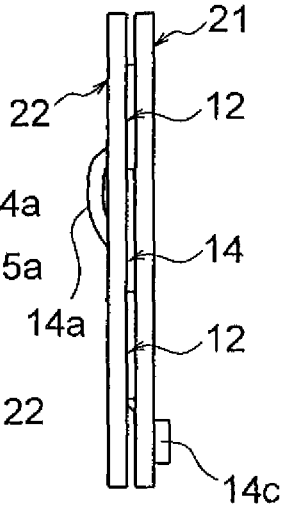
FIG. 8B is a side view of the same.

Finally, the secondary member 16 is processed such as punched into a predetermined shape conforming to the external shape and size of the cover member 15, thereby forming a connector shown in FIGS. 8A and 8B (connector forming step).

According to the connector manufacturing method described above with reference to FIGS. 2A to 8B, the terminal member 14 can be fixed without requiring the insert injection molding. Therefore, a mold is not required so that the equipment cost can be reduced. Since there is no occurrence of unfilling of a material into a mold or no burr formation which may otherwise be caused at the time of insert injection molding, the quality of the connector can be improved. Since the base member 11, the intermediate members 12, the terminal member 14, and the cover member 15 can each be easily formed by applying laser processing, pressing, or the like to the sheet-like material, the processing cost can be made low and, further, the connector can be made thin.

Hereinbelow, the structure of the connector shown in FIGS. 8A and 8B will be described.

The connector of FIGS. 8A and 8B comprises an insulating base film 21, i.e. the base member 11, formed from the first sheet member and an insulating cover film 22, i.e. the cover member 15, formed from the third sheet member and facing the base film 21 with a space therebetween. The conductive terminal member 14 with no joining portion 14*d* is disposed between portions of the base film 21 and portions of the cover film 22. The insulating intermediate members 12 are disposed between other portions of the base film 21 and other portions of the cover film 22.

The intermediate members 12 formed into the predetermined shapes are disposed adjacent to the terminal member 14 so as not to overlap the terminal member 14, thereby positioning the terminal member 14. The base film 21 and the cover film 22 are each melt-fixed to the intermediate members 12 by a laser beam. In this event, an ultrasonic wave and/or a heater may be used instead of the laser beam in this melt-fixing. In this manner, the terminal member 14 is directly sandwiched by the base film 21 and the cover film 22 so as to be firmly held and fixed at the predetermined position therebetween.

The cover film 22 has the openings 15*a*. A part of each contact portion 14*a* of the terminal member 14 passes through the opening 15*a* and protrudes outward of the cover film 22 so as to be exposed to the outside. A part of each connecting portion 14*c* of the terminal member 14 protrudes outward of the base film 21.

Therefore, the connector of FIGS. 8A and 8B can be used such that the base film 21 is caused to face a circuit board (not illustrated) to allow the connecting portions 14*c* of the terminal connector 14 to be electrically connected to the circuit board and that the cover film 22 is caused to face a mating connector to allow the contact portions 14*a* of the terminal portion 14 to be electrically connected to the mating connector.

It is to be noted that the base film 21 and the cover film 22 each have a transmittance of 20% or more for light having a wavelength of 600 nm to 1200 nm.

In the case of the connector of FIGS. 8A and 8B, since the intermediate members 12 and the terminal member 14 are interposed, not in a stacked manner but in a parallel manner, between the base film 21 and the cover film 22, a reduction in thickness is easily enabled and further the connector is structurally stable so that interfacial fracture hardly occurs at the bonding portions between the base film 21 and the intermediate members 12 and between the cover film 22 and the intermediate members 12.

Next, referring to FIGS. 9A to 12B, a connector according to a second embodiment of this invention will be described using its manufacturing method. The same reference symbols are assigned to the same portions as those of the connector according to the first embodiment, thereby omitting an explanation thereof.

Figure 9A:
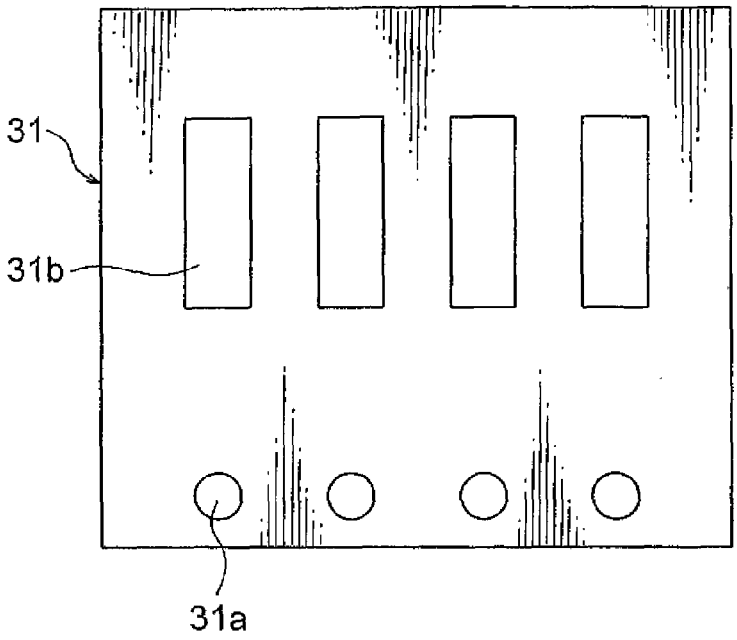
FIG. 9A is a plan view of a base member for use in the manufacture of a connector according to a second embodiment of this invention.
Figure 9B:
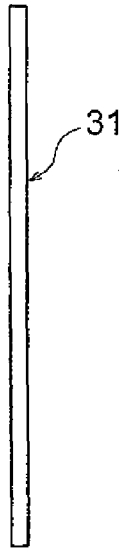
FIG. 9B is a side view of the same.

As shown in FIGS. 9A and 9B, the above-mentioned first sheet member is processed by a laser beam, pressing, or the like, thereby forming a film-like base member 31 having a predetermined shape (base member forming step). Specifically, the roll-like resin film is continuously punched by a laser beam, pressing, or the like, thereby forming the base member 31. The base member 31 has four positioning holes 31*a* arranged in a row and four large windows 31*b* penetrating in its thickness direction at positions respectively corresponding to the positioning holes 31*a*.

Figure 10A:
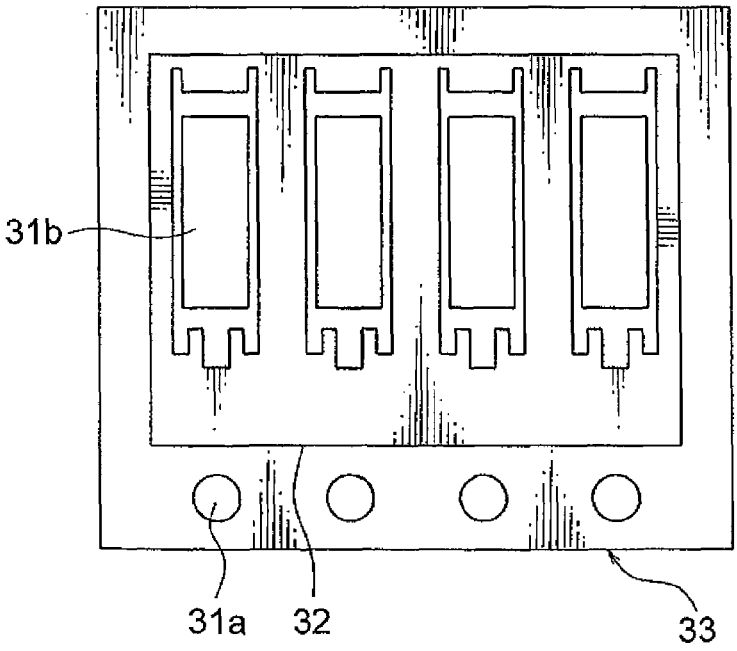
FIG. 10A is a plan view of a primary member formed by fixing an intermediate member to the base member of FIGS. 9A and 9B.
Figure 10B:
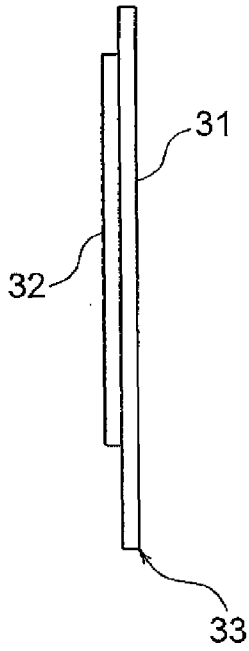
FIG. 10B is a side view of the same.

As shown in FIGS. 10A and 10B, the above-mentioned second sheet member is processed by a laser beam, pressing, or the like, thereby forming a single insulating intermediate member 32 having a predetermined shape (intermediate member forming step), and this intermediate member 32 is disposed on a first surface of the base member 31 and then is melt-fixed to the base member 31 by a laser beam (light having a wavelength of 600 nm to 1200 nm) so as to be integrated with the base member 31, thereby forming a primary member 33 (primary member forming step). The intermediate member 32 is disposed so as to extend slightly away from the large windows 31*b* of the base member 31. The laser beam is preferably irradiated from the opposite surface side of the base member 31, i.e. irradiated to a second surface, opposite to the first surface, of the base member 31. In this event, a part of the laser beam passes through the base member 31 so as to be absorbed by the intermediate member 32. As a consequence, the base member 31 and/or the intermediate member 32 are/is properly melted so that interface portions thereof are melt-fixed to each other so as to be integrated with each other. In this event, although the laser beam is used for melt-fixing in the above description, an ultrasonic wave and/or a heater may be used for the meld fixing.

Figure 11A:
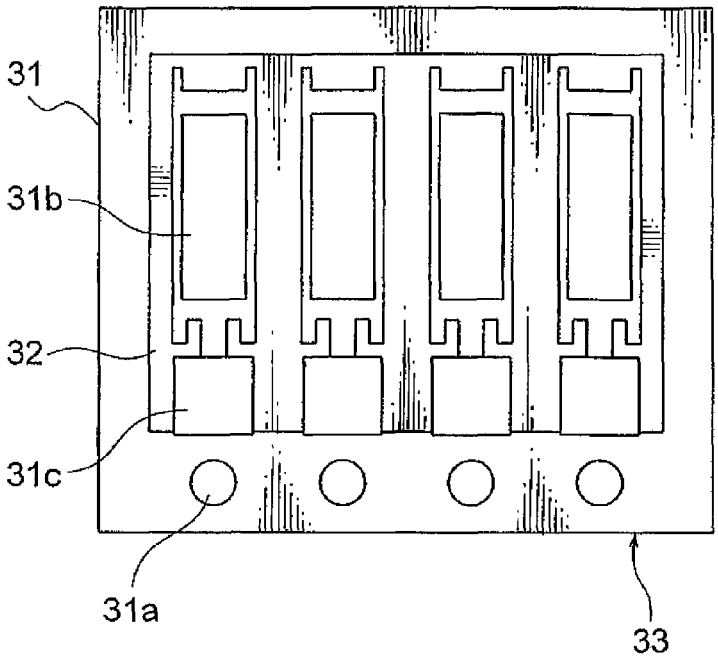
FIG. 11A is a plan view showing a state after the primary member of FIGS. 10A and 10B is subjected to perforation.
Figure 11B:
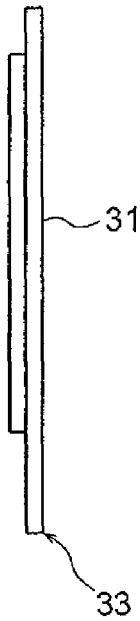
FIG. 11B is a side view of the same.

Further, as shown in FIGS. 11A and 11B, the primary member 33 is processed such as punched by a laser beam, pressing, or the like, thereby forming small windows 31*c* respectively between the positioning holes 31*a* and the large windows 31*b*.

Figure 12A:
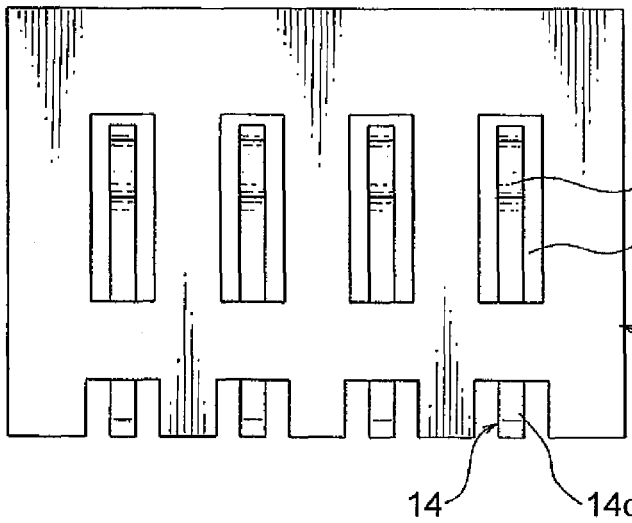
FIG. 12A is a plan view of the connector according to the second embodiment.
Figure 12B:
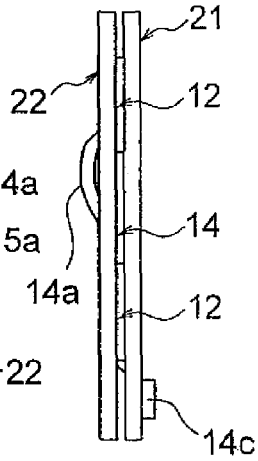
FIG. 12B is a side view of the same.

Then, as in the first embodiment, a terminal member 14 and a cover member 15 are disposed on the primary member 33 and then integrated with the primary member 33 and, thereafter, processing such as punching is carried out, thereby forming a connector shown in FIGS. 12A and 12B.

The connector shown in FIGS. 12A and 12B is substantially the same as the connector shown in FIGS. 8A and 8B except that the intermediate member 32 slightly differs from the intermediate members 12. Therefore, a description of the connector shown in FIGS. 12A and 12B is omitted.

This invention is not limited to the above-mentioned embodiments and a part or the whole of the above-mentioned embodiments can also be described as the following supplementary notes, but these supplementary notes do not specify the scope of this invention.

(Supplementary Note 1)

A connector comprising:

a base film 21 having insulating property;

a cover film 22 having an insulating property and facing the base film with a space left therebetween;

a terminal member 14 having a conducting property and disposed between a portion of the base film and a portion of the cover film; and an intermediate member 12 having an insulating property and disposed between another portion of the base film and another portion of the cover film, wherein the intermediate member is formed in a predetermined shape and is located so as not to overlap the terminal member, and the base film and the cover film are each melt-fixed to the intermediate member by a laser beam, whereby the terminal member is fixedly held between the base film and the cover film.

(Supplementary Note 2)

The connector according to supplementary note 1, wherein the base member and the cover member directly hold the terminal member therebetween.

(Supplementary Note 3)

The connector according to supplementary note 1 or 2, wherein at least one of the base film and the cover film has a window 11*b*, 15*a*, 31*b* penetrating in its thickness direction, the terminal member has a contact portion 14*a* at a position corresponding to the window, and the contact portion is exposed to the outside through the window.

(Supplementary Note 4)

The connector according to supplementary note 3, wherein at least one of the base film and the cover film has a cutout portion 11*c*, 31*c* penetrating in its thickness direction and the terminal member has a connecting portion 14*c* at a position corresponding to the cutout portion.

(Supplementary Note 5)

The connector according to supplementary note 3 or 4, wherein the terminal member has a frame portion 14*b* adjacent to the window and surrounding the contact portion.

(Supplementary Note 6)

The connector according to supplementary note 1, wherein the each of the base member and the cover member is melt-fixed to the intermediate member by a laser beam.

(Supplementary Note 7)

The connector according to any one of supplementary notes 1 to 6, wherein at least one of the base film and the cover film is made of a material having a transmittance of 20% or more for light having a wavelength of 600 nm to 1200 nm and the intermediate member is made of a material having an absorbance of 50% or more for the light having the wavelength of 600 nm to 1200 nm.

(Supplementary Note 8)

A connector manufacturing method comprising:

a base member forming step of processing a first sheet member by a laser beam or pressing, thereby forming a base member having a predetermined shape;

an intermediate member forming step of processing a second sheet member by a laser beam or pressing, thereby forming an intermediate member having a predetermined shape;

a primary member forming step of melt-fixing the base member and the intermediate member together to integrate them together, thereby forming a primary member;

a terminal member forming step of processing a metal sheet by a laser beam or pressing, thereby forming a terminal member having a predetermined shape;

a cover member forming step of processing a third sheet member by a laser beam or pressing, thereby forming a cover member having a predetermined shape;

a disposing step of disposing the terminal member at a predetermined position of the primary member and then disposing the cover member at a predetermined position over the terminal member;

a secondary member forming step of melt-fixing the intermediate member and the cover member together, thereby forming a secondary member in which the terminal member is fixedly held between the base member and the cover member; and a connector forming step of processing the secondary member into a predetermined shape, thereby forming a connector.

(Supplementary Note 9)

The connector manufacturing method according to supplementary note 8, wherein the base member and the intermediate member are fixed to each other by a laser beam in the primary member forming step, and the intermediate member and the cover member are melt-fixed to each other by a laser beam in the secondary member forming step.

(Supplementary Note 10)

The connector manufacturing method according to supplementary note 8 or 9, further comprising a step of processing the primary member into a predetermined shape by a laser beam or pressing.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connector comprising:

a base member having insulating property;

a cover member having an insulating property and facing the base member with a space left therebetween;

a terminal member having a conducting property and disposed between a portion of the base member and a portion of the cover member; and an intermediate member having an insulating property and disposed between another portion of the base member and another portion of the cover member, wherein the intermediate member is formed in a predetermined shape and is located adjacent to the terminal member in a plane parallel to the base member, and the base member and the cover member are each melt-fixed to the intermediate member, whereby the terminal member is positioned by the intermediate member within the space.

2. The connector according to claim 1, wherein the base member and the cover member directly hold the terminal member therebetween.

3. The connector according to claim 1, wherein at least one of the base member and the cover member has a window penetrating in its thickness direction, the terminal member has a contact portion at a position corresponding to the window, and the contact portion is exposed to the outside through the window.

4. The connector according to claim 3, wherein at least one of the base member and the cover member has a cutout portion penetrating in its thickness direction and the terminal member has a connecting portion at a position corresponding to the cutout portion.

5. The connector according to claim 3, wherein the terminal member has a frame portion adjacent to the window and surrounding the contact portion.

6. The connector according to claim 1, wherein the each of the base member and the cover member is melt-fixed to the intermediate member by a laser beam.

7. The connector according to claim 6, wherein at least one of the base member and the cover member is made of a material having a transmittance of 20% or more for light having a wavelength of 600 nm to 1200 nm and the intermediate member is made of a material having an absorbance of 50% or more for the light having the wavelength of 600 nm to 1200 nm.

8. A connector manufacturing method comprising:

a base member forming step of processing a first sheet member by a laser beam or pressing, thereby forming a base member having a predetermined shape;

an intermediate member forming step of processing a second sheet member by a laser beam or pressing, thereby forming an intermediate member having a predetermined shape;

a primary member forming step of melt-fixing the base member and the intermediate member together to integrate them together, thereby forming a primary member;

a terminal member forming step of processing a metal sheet by a laser beam or pressing, thereby forming a terminal member having a predetermined shape;

a cover member forming step of processing a third sheet member by a laser beam or pressing, thereby forming a cover member having a predetermined shape;

a disposing step of disposing the terminal member at a on the base member so as to be adjacent to the intermediate member, and then disposing the cover member over the intermediate member and the terminal member;

a secondary member forming step of melt-fixing the intermediate member and the cover member together, thereby forming a secondary member in which the terminal member is positioned by the intermediate member within a space between the base member and the cover member; and a connector forming step of processing the secondary member into a predetermined shape, thereby forming a connector.

9. The connector manufacturing method according to claim 8, wherein the base member and the intermediate member are fixed to each other by a laser beam in the primary member forming step, and the intermediate member and the cover member are melt-fixed to each other by a laser beam in the secondary member forming step.

10. The connector manufacturing method according to claim 9, further comprising a step of processing the primary member into a predetermined shape by a laser beam or pressing.

* * * * *

UNITED STATES PATENT AND TRADEMARK OFFICE

CERTIFICATE OF CORRECTION

PATENT NO. : 8,690,613 B2
APPLICATION NO. : 13/406973
DATED : April 8, 2014
INVENTOR(S) : Yoshida et al.

It is certified that error appears in the above-identified patent and that said Letters Patent is hereby corrected as shown below:

In the Claims

In particular, in Column 10, line 20 (line 18 of Claim 8) after "member" please delete: "at a".

Signed and Sealed this
Eighth Day of July, 2014

Michelle K. Lee

Michelle K. Lee
*Deputy Director of the United States Patent and Trademark Office*